340-552 SR
OR 4,052,716
/552 X340/578
X340/555
X340/567

United States
Mortensen

4,052,716
Oct. 4, 1977

[54] FIRE AND INTRUDER DETECTION AND ALARM APPARATUS

[76] Inventor: Tage A. Mortensen, 904 Lake of the Forest, Bonner Springs, Kans. 66012

[21] Appl. No.: 671,267

[22] Filed: Mar. 29, 1976

[51] Int. Cl.[2] ..... G08B 21/00
[52] U.S. Cl. ..... 340/233; 340/228 R; 340/258 R; 340/420
[58] Field of Search ..... 340/233, 228 R

[56] References Cited

U.S. PATENT DOCUMENTS

| | | | |
|---|---|---|---|
| 2,871,466 | 1/1959 | Vassil | 340/233 |
| 3,117,311 | 1/1964 | LeMaire | 340/233 |
| 3,191,068 | 6/1965 | Robb | 340/233 |
| 3,494,196 | 2/1970 | Moussette | 340/233 |
| 3,636,540 | 1/1972 | Harris | 340/233 |
| 3,725,660 | 4/1973 | Doherty | 340/233 |
| 3,737,886 | 6/1973 | Dinges | 340/233 |

FOREIGN PATENT DOCUMENTS

| | | | |
|---|---|---|---|
| 1,220,289 | 6/1966 | Germany | 340/233 |

*Primary Examiner*—Thomas B. Habecker
*Attorney, Agent, or Firm*—Schmidt, Johnson, Hovey & Williams

[57] ABSTRACT

Improved apparatus is provided for monitoring a space under surveillance, for detecting the existence of a fire, the presence of an intruder or the occurrence of other abnormal conditions, and for providing a warning signal for actuating an alarm or the like in response thereto. The apparatus employs a plurality of sensors which respond by changes in the electrical characteristics thereof to the level of infrared, light or other radiations from the monitored space respectively sensed thereby. The apparatus significantly provides means for rendering the individual sensors directionally responsive to radiations from respectively corresponding portions of the space being monitored, for employing such sensors as output-affecting elements in more than a single arm of an electrical bridge circuit, for employing such sensors when desired in a plurality of operationally related electrical bridge circuits, for employing capacitative coupling between the output of a sensor-controlled bridge circuit and a differential amplifier to "mask" very slow changes in the output of the bridge circuit due to normal ambient variations while retaining high sensitivity in responding to more rapid changes of such output typical of fire, intruder or other abnormal conditions requiring alarm actuation, for employing such differential amplifier for converting changes in capacitatively coupled output from a sensor-controlled bridge circuit into direct current signals of polarity dependent upon the direction of change in such bridge circuit output, and for employing bridge type rectification for converting signals of either polarity from such differential amplifier into control signals of a single polarity for actuating an alarm activating switching component.

16 Claims, 4 Drawing Figures

FIRE AND INTRUDER DETECTION AND ALARM APPARATUS

BACKGROUND OF THE INVENTION

This invention relates to apparatus for detecting fires, intruders or other abnormal conditions to be monitored within a space under surveillance and for providing alarm actuating signals in response thereto, and, more particularly, to such apparatus of the type employing a plurality of electrically variable sensors which respond to infrared, light or other radiations received thereby. More specifically, the invention is concerned with providing improved detection and alarm apparatus which overcomes the disadvantages and operational limitations of prior devices for the same general purpose, especially with respect to enhanced sensitivity for the conditions actually to be monitored and increased reliability in practical application, including the ability to discriminate against and avoid generating "false alarms" in response to insignificant events such as slow normal changes in ambient conditions.

Known prior detection and alarm systems based upon radiation sensing have historically suffered from either relative insensitivity to the types of conditions actually to be detected or relative vulnerability to "false alarms" caused by insignificant changes in ambient conditions when an effort is made to improve sensitivity, or from the operational limitations imposed by trying to compromise those conflicting considerations in a manner sacrificing optimality as to both. The earliest such systems, which are still in common use despite their disadvantages, employed a single radiation sensitive sensor whose internal electrical impedance characteristic (usually the series resistance therethrough, although the amount of electrical current produced by self-generating types radiation sensing components may have been also equivalently employed) is altered in response to the level of radiation applied to the sensor. In such early systems, the single sensor has been employed in some suitable electrical circuit whose output is essentially controlled in correlation with the variable impedance of the single sensor and, therefore, the variable level of radiations to which such sensor is subjected from the space being monitored by it; typically, such single sensor has been employed as a series impedance in a single arm of a bridge circuit whose other arms contain fixed lumped impedance elements. Thus, it will be appreciated that the sensitivity of such earlier systems has been inherently limited in the first instance in two ways — first, by virtue of the employment of only a single sensor to sense radiations on a gross basis for the entire space being monitored, which is thus inherently responsive only to changes in the overall level of radiations received from the space, and secondly, by virtue of the relative insensitivity of bridge circuits having a variable impedance (the single sensor) in only a single arm thereof to respond to quick small changes. It will be appreciated that even efforts to focus radiations from different parts of a space upon a single sensor (as by multiple mirrors) is alone inherently incapable of overcoming the inevitable limitation upon sensitivity imposed by the electrical aspects of employing only a single sensor. Moreover, attempts to improve sensitivity characteristics in such single sensor systems by providing sufficient "follow-up" amplification have resulted in loss of reliability through increased vulnerability to "false alarms".

It is understood that some attempts have been made to improve the characteristics of the early single sensor systems by employing a plurality of sensors, redundantly responsive on an essentially gross basis to radiations from the same space, electrically coupled in series or parallel with each other, so that an additive electrical effect may be derived with a given type of sensing components from a given amount of radiation from the space under surveillance acting upon multiple sensors; but such attempts are further understood to have involved merely treating the intercoupled plurality of sensors as essentially a single variable impedance element with regard to the coupling thereof into a single arm of a bridge circuit or the like for purposes of providing an electrical output in which changes could be detected. This approach also failed to solve, or apparently even to grasp the real nature and causes of, the problems inherent in all known earlier systems, which arise from their treating the space under surveillance on a gross basis and from their employment of what effectively amounts to only a single variable impedance sensing means in only a single arm of a bridge or some other circuitry arrangement in which variations in the sensing responsive impedance can only "work against" fixed impedance elements in some voltage dividing arrangement to produce variations in an electrical output representative of the changes in radiation conditions to be sensed.

It is also understood that efforts have been made to decrease the vulnerability of the early single sensor systems to "false alarms" by attempts to improve the signal-to-noise ratio of the system involving the employment of sensor type components in more than one arm of a bridge circuit, but with only a single one of such components in a single arm of the bridge circuit being exposed and responsive to radiations from the space being monitored, and the remainder of such components being shielded from such radiations and effectively employed merely as lumped impedance elements whose essentially fixed values are automatically "adjusted" momentarily in response to electrical "noise" factors or ambient changes affecting the impedances of all such components (but unrelated to significant radiation parameters of the space being monitored). Although such arrangements can increase the general stability of a system by tending to offset the effects of such "internal" factors as the temperature-impedance coefficients of the components, supply voltage variations or the like, it will be clear that they have not solved, or even directly addressed, the problem of the limited sensitivity inherent in the employment of only a single monitored radiation sensing sensor and the susceptibility of such radiation sensing systems to "false alarms".

SUMMARY OF THE INVENTION

Accordingly, it is the broad objective of this invention to directly attack the root causes of the limitations and disadvantages characterizing prior radiation sensing type alarm systems and to provide improved apparatus of that class having both increased sensitivity to the significant radiation parameters to be detected and increased reliability involving lowered vulnerability to "false alarms" triggered by irrelevant factors.

My improved apparatus, in a preferred embodiment sense, employs a plurality of radiation sensors for directionally responding to radiations from respectively corresponding (and preferably, as to at least some of the sensors, differing) portions of a space under surveillance, which have their radiation responsive, variable electrical impedances electrically coupled into a plurality (optimumly, all) of the arms of one or more electrical bridge circuits, the outputs of which are capacitatively coupled to differential amplifying means for converting relatively rapid changes in bridge output signals into signals of whichever polarity corresponds to the direction of change in the bridge output signals, which signals are fed to electrical rectifying means for producing control signals of a single polarity but varying level for controlling electrical switching means that in turn control the activation of an alarm or the like.

As will hereafter become more apparent, the employment of a plurality of directionally selective sensors electrically coupled in different arms of a bridge circuit and the employment of capacitative coupling at the output of the bridge circuit are believed to be particularly significant in achieving both increased reliability and significantly increased sensitivity (including the ability to detect and provide an algebraically enhanced response to a moving or shifting radiation source within the space being monitored, which might not materially change the gross amount of radiations emanating from the space as a whole and thus go undetected by conventional prior systems), although the comprehensive nature of the improvements effected by the invention is, of course, more fully treated in the accompanying claims.

DESCRIPTION OF THE PREFERRED EMBODIMENT AND CERTAIN ILLUSTRATIVE VARIATIONS THEREOF

Figures 1, 4:
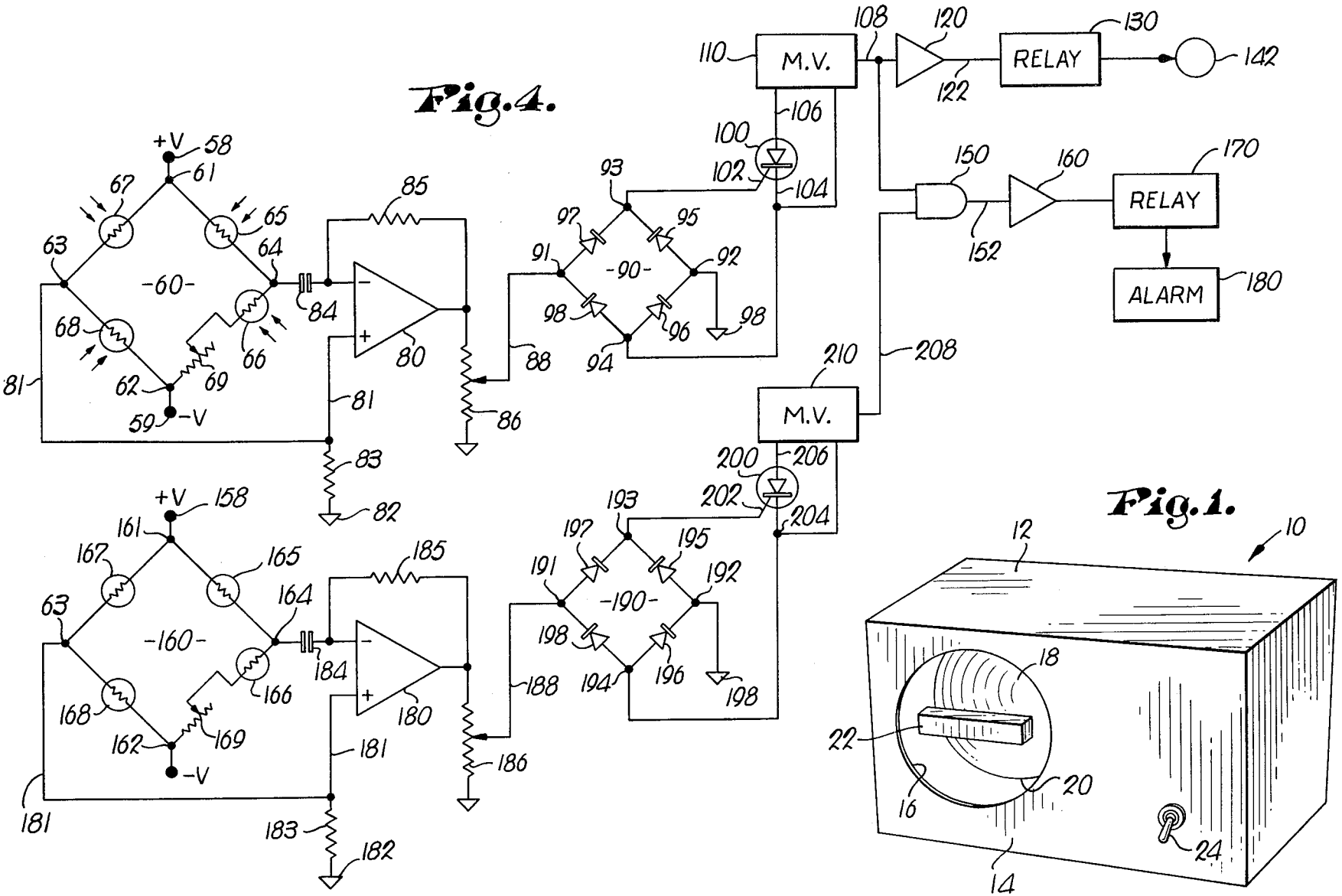
FIG. 1 is a perspective view of the exterior of a typical embodiment of my apparatus, illustrating an enclosure for the electrical circuitry portions thereof, which is provided with means for mounting the radiation sensors of the apparatus and rendering them directionally responsive to radiations from corresponding portions of an external space to be monitored.
FIG. 4 is a schematic diagram of the electrical portions of one illustrative modified form of the apparatus.

With the above-noted general nature and purpose of the invention in mind, reference may first be had to FIG. 1 showing the exterior aspects of a typical embodiment of my improved apparatus 10.

Figures 2, 3:
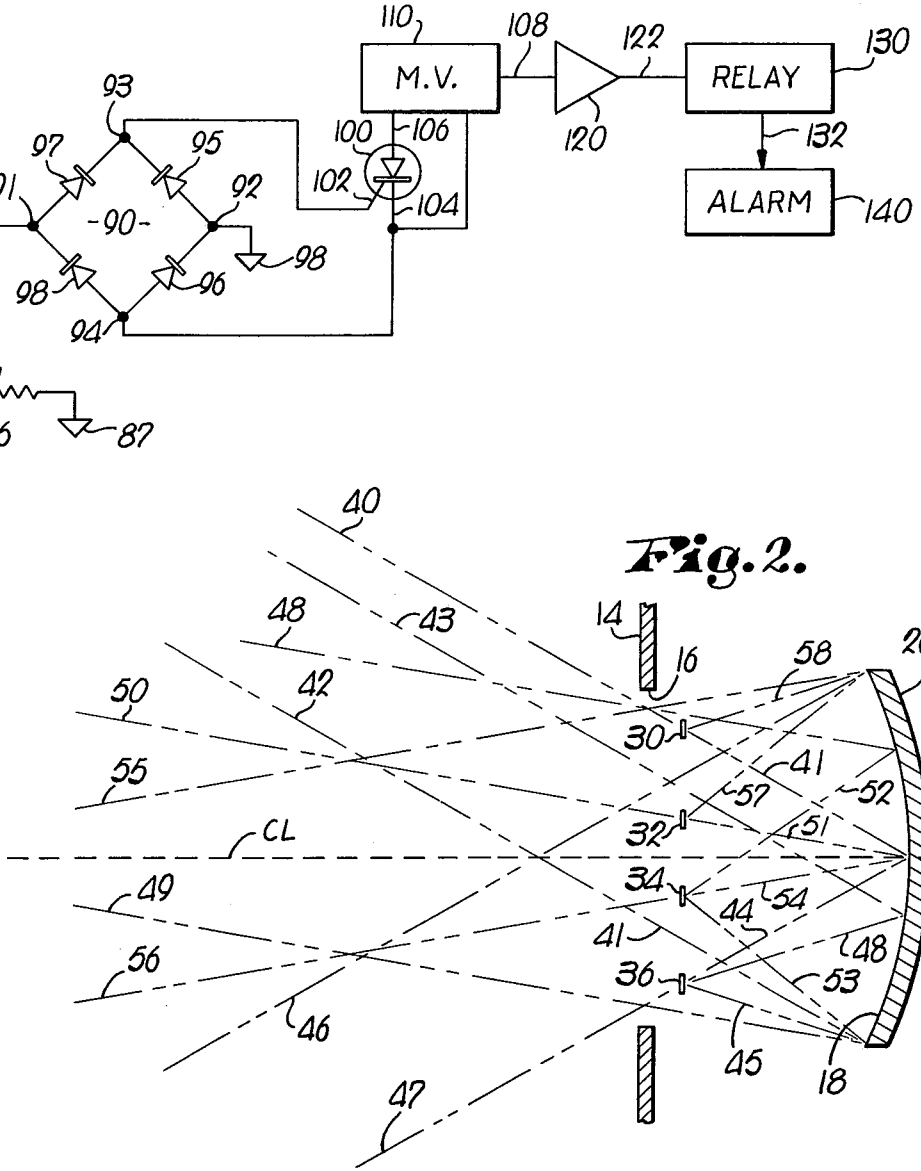
FIG. 2 is a schematic depiction of the manner in which my preferred form of the apparatus employs a reflecting surface juxtaposed with the sensors to render respective ones of the latter responsive to radiations from different portions of the space under surveillance.
FIG. 3 is a schematic diagram of the electrical portions of my currently preferred embodiment of the apparatus.

The apparatus 10, including the electrical circuitry portions thereof hereinafter described with reference to FIGS. 3 and 4, is conveniently housed in a box-like enclosure 12 having a front wall 14 adapted to face the space to be monitored. The wall 14 is provided with an aperture 16 for passing radiations from the space under surveillance onto the front reflecting surface 18 of a mirror 20 mounted in any suitable fashion behind the aperture 16 and within the enclosure 12 for protection thereof. As also indicated in FIG. 2, the reflecting surface 18 is curved and normally will be of concave spherical curvature, although parabolic of other "focusing" surface configurations could be used if desired. A bracket or other suitable structure 22 for supporting a plurality of radiation sensors which are shielded from view by the structure 22 in FIG. 1 is mounted in any suitable fashion in frontally spaced relationship to the reflective surface 18 and is thus disposed between a relatively limited area of the latter and the space to be monitored. It should be understood that the sensors hereinafter further described are arranged and supported along the length of structure 22 and have their radiation responsive sides facing rearwardly toward the reflective surface 18, and that the structure 22 preferably shields such sensors from receiving radiations from the space being monitored other than those reflected from the surface 18. An on-off switch 24 for controlling the application of operating power to the electrical circuitry portions of the apparatus 10 is conveniently provided on the wall 14 of enclosure 12.

Referring next to FIG. 2, it should initially be noted that the schematic depiction provided therein for the purpose of facilitating further explanation of the relationships between sensors having illustrative positions represented at 30, 32, 34 and 36, the mirror 20, and radiations from different portions of the space under surveillance is a two-dimensional representation thereof; whereas the actual relationships, the space and the mirror 20 are, of course, significantly three-dimensional in character. It should suffice, however, for understanding of the manner in which the respective sensors at 30, 32, 34 and 36 each respond in a directional or selective manner to radiations from a particular three-dimensional portion of the space being monitored, to consider such matter for simplicity of illustration and explanation from a two-dimensional viewpoint. Since the positions of sensors 30, 32, 34 and 36 are spaced along the supporting structure 22 (FIG. 1), which is horizontally extending in the preferred embodiment, FIG. 2 may be regarded as a generally horizontal "slice" through the space being monitored and the approximate vertical center of the mirror 20 (but assuming a sufficient inclination of the elevational angle of approach of the depicted radiations toward the mirror 20 for clearing the small zone of "shielding" presented by the sensors 30, 32, 34 and 36 and their support structure 22).

In such context, and assuming the reflective surface 18 of the mirror 20 to be of spherical curvature, as preferred, consider the effect of radiations emanating from a particular zone of the space being monitored which is so located with respect to the aperture 16 and the surface 18 that the dotted lines 40–41 and 42 represent the boundary paths (in the "slice" depicted) for radiations from that particular zone that will both pass through the aperture 16 and impinge upon the surface 18. Those skilled in the art will understand that radiations from the same zone will also traverse other intermediate paths such as represented by the dotted line 43 and impinge upon the surface 18 at points disposed between the intersections of boundary path lines 41 and 42 with the surface 18, and it may safely be further assumed for convenience of explanation and without sacrifice of principle that the radiation zone under consideration is sufficiently distant from the aperture 16 and mirror 20 that all radiations from such zone may be treated as arriving at the surface 18 along substantially parallel paths. Since the radiations arriving at the surface 18 will all be reflected from the latter at an angle from the tangent of the curvature of the surface 18 at the point of their impingement thereon equal and opposite to the angle of their arriving impingement therewith, it will be seen that radiations from the zone under consideration arriving at the surface 18 along boundary path 40–41 will be reflected along path 44 selectively toward the radiation sensor 36, radiations arriving along the opposite boundary path 42 will be reflected along path 45 selectively toward the same sensor 36, and radiations arriving along an intermediate path such as 43 will be reflected along a path such as 48 selectively also toward the sensor 36. It is, of course, not intended to indicate that in practical embodiments there may not be some dispersion of radiations departing from the idealized paths noted; rather it is intended to emphasize that the relationships between the aperture 16, the surface 18 and the mutually displaced sensor positions 30, 32, 34 and 36 effectively tend to selectively concentrate radiations arriving from a particular zone of the space being monitored upon a particular one (or more, since as later noted additional sensors may be used and arranged in positions adjacent those depicted in FIG. 2) of the sensors, so that the sensors essentially respond with directional selectively to radiations from corresponding particular parts of the space being monitored.

To complete the illustration, next consider the effect of radiations from a zone of the space being monitored that is disposed toward the opposite side of the latter from the zone discussed in the preceding paragraph. As would be expected, radiations from which such a zone approach the mirror 20 along lines effectively between boundary paths 46 and 47–44 will be selectively reflected toward the sensor 30 along reflection paths such as those for the boundary approaches, which are respectively indicated by the dotted lines 58 and 41. Next consider the effect of radiations from a zone of the space being monitored that is located on the same side of the center line CL of the surface 18 as the zone first considered, but which is displaced from the center line 50 by a lesser angle. The bounding paths for such a zone are indicated by the dotted lines 48 and 49 with an intermediate path depicted by the dotted line 50–51, the respective reflection paths for which are indicated by dotted lines 52, 53 and 54, all of which concentrate upon the sensor 34. The effect of radiations from another zone correspondingly offset in the opposite direction from the center line CL is partially indicated in FIG. 2 by one boundary path line 55 and an intermediate path line 56–54, which respectively will reflect from the surface 18 along paths 57 and 51 to concentrate upon the sensor 32.

Before leaving consideration of FIG. 2, several clarifying observations should be made. First, the important function of the structure and relationships illustrated in the drawing and described above is to render the various individual sensors at positions 30, 32, 34 and 36 each predominately responsive to radiations from some particular corresponding portion of the space being monitored, although it should be understood that, particularly when additional sensors are employed, there will tend to be some degree of overlapping between the portions of the space to which individual sensors are at least to some extent responsive; indeed, as later explained, one arrangement of sensors that can be advantageously employed involves the disposition of a pair of adjacent sensors at each of the locations 30, 32, 34 and 36, with each such pair arranged to respond to radiations from substantially the same portion of the space being monitored and the respective pairs responding to radiations from different portions of such space. Secondly, although the mentioned function is conveniently and effectively accomplished in my preferred embodiment through the use of the aperture 16 and mirror 20, it is recognized and contemplated to be within the spirit of my invention that such function could also be accomplished through the employment of refractive, rather than reflective, means for focusing radiations selectively upon the different sensors depending upon the portion of the space being monitored from which such radiations emanate. Thirdly, it is noted that the sensors such as at positions 30, 32, 34 and 36 may be of types responsive to whatever kinds of electromagnetic radiations are to be sensed thereby, typical examples being sensors responsive to infrared radiations and sensors responsive to visible light spectrum radiations; and as will be apparent to those skilled in the art, the reflecting means 20 to be employed will also be chosen for effectiveness in reflecting the particular kinds of radiations to be sensed. Fourthly, it is noted that for systems intended to respond primarily to intruder and fire conditions, I prefer to employ a mixture of sensors of which some are of the infrared sensitive type and others are of the visible light sensitive type, as will be further explained in connection with the schematic system diagrams of the apparatus 10 shown in FIGS. 3 and 4. It should also be understood that in referring herein to "sources" of radiations within the spece being monitored, it is intended to include not only self-generating rdiation sources, but also objects or events which either block from or reflect toward the sensors radiations from fixed or other radiation sources.

Referring now to FIG. 3, it will be seen that the currently preferred embodiment of my invention broadly includes a first sensing bridge circuit 60, a second sensing bridge circuit 70 (which is actually optional, although preferably included as hereinafter explained), a differential amplifier 80, rectifying bridge circuit 90, an electronic switch 100, a multivibrator 110, an output or driver amplifier 120, a relay 130, and an electrically responsive alarm component 140.

The bridge circuit 60 is of the usual Wheatstone configuration having a pair of reference terminals 61 and 62, a pair of output terminals 63 and 64 and four impedance arms between adjacent pairs of the terminals 61, 62, 63 and 64, but differs from conventionally employed impedance bridge arrangements in that the impedance elements in at least a plurality of the arms are of dynamically variable electrical characteristics, as contrasted with the more conventional arrangement in which three of the arms contain essentially fixed (albeit perhaps statically adjustable) impedances with only the fourth arm containing an impedance of dynamically variable or unknown value. The variable impedances in the arms of the bridge circuit 60, and preferably in all of the arms thereof, are provided by the variable impedance (normally resistance) characteristics of radiation sensors 65, 66, 67 and 68, the instantaneous impedance values of which depend upon the respective level of radiation being sensed thereby. The sensors whose dynamically variable impedances 65, 66, 67 and 68 are shown electrically in FIG. 3 may be understood for example, to correspond positionally to the physical representations of the sensor positions 30, 32, 34 and 36 respectively shown in FIG. 2. A statically adjustable resistance 69 is provided in series with the arm of the bridge circuit 60 also containing the sensor impedance 66, in order to permit suitable initial adjustment of the bridge circuit 60 for a desired "balance" (but not necessarily zero) level of output therefrom in response the the normal radiation pattern of the space under surveillance. The reference termainals 61 and 62 are coupled with the positive terminal 58 and negative terminal 59 of any suitable source of direct current reference voltage (unless an external reference source is rendered unnecessary by the equivalent use of a kind of sensors whose "impedances" 65, 66, 67 and 68 are of the self-generating type that internally produce an electrical voltage in response to radiations). In the preferred embodiment, the sensors 65, 66, 67 and 68 are all of the kind whose electrical resistance varies with the level of radiation applied thereto and of the type which respond with greatest sensitivity to infrared radiations applied thereto, although they could for other applications be of type responsive to some entirely different type of electromagnetic reactions or of respectively differing types adapted to respond to correspondingly different types of radiations expected to emanate from the space being monitored, it that should be desired.

Ignoring the second bridge circuit 70 for the moment since, although included in the peferred embodiment, it is actually optional from the standpoints of operability of the apparatus 10 and explaining the basic operation of the latter. it is noted that one of the output terminals 63 of the bridge circuit 60 is coupled via conductive means 81 with the non-inverting input terminal of the differential amplifier 80, such conductive means 81 also being coupled to signal ground 82 through a resistance 83 to provide the bridge 60 and the amplifier 80 with a common signal ground reference. The other output terminal 64 of the bridge circuit is capacitatively coupled to the inverting input terminal of differential amplifier 80 through a capacitance 84. The output terminal of the differential amplifier 80 is conventionally coupled through a feedback resistance 85 back to the inverting input terminal of the amplifier 80 for supporting the amplification function of the latter. The output terminal of the differential amplifier 80 is also coupled with one end of a variable resistance 86 that os oppositely connected to signal ground 87 and provided with an adjustable tap lead 88 for presenting a usable output signal from the differential amplifier 80.

Because of the capacitative coupling via capacitance 84 between the sensing bridge circuit 60 and the differential amplifier 80, those skilled in the art will appreciate that no output signal is presented at the output lead 88 during periods when the output from terminal 63 and 64 of the bridge circuit 60 remains constant at any level, that the differential amplifier 80 effectively responds only to changes in the "balance" between or relative electrical potentials of the terminals 63 and 64 of the sensing bridge circuit 60, that the differential amplifier 80 responds to such changes in the "balance" of the bridge circuit 60 by presenting at the output lead 88 an output signal of either positive or negative polarity depending upon the sense of the change in balance of the bridge circuit 60, and that rapid changes in the balance of the bridge circuit 60 will present at the output lead 88 an output signal of substantial magnitude, while slower changes in the balance of the bridge circuit 60 will produce little or no significant output signal at the output lead 88.

It will be clear, of course, that whenever the effective impedance of any of the sensors 65, 66, 67 or 68 is altered by the application of an increased or decreased level of radiation applied thereto from the particular portion of the space under surveillance which it directionally monitors, a corresponding change in the balance conditions of the bridge circuit 60 will occur resulting in a corresponding, amplified output signal at the output lead 88. An example of a cause of increased radiation being applied to a particular sensor would be the occurrence of a flame, and an example of a cause of decresed radiation to a particular sensor would be the opening by an intruder of a window between the space under surveillance and a substantially cooler exterior area. Since every arm of the sensing bridge circuit 60 contains a dynamically variable sensor and associated impedance 65, 66, 67 and 68, and since each of such sensors is especially sensitive to changes in the radiation pattern from a particular portion of the space under serveillance, it is apparent that greatly enhanced sensitivity is achieved, as compared with conventional radiation sensing systems employing only a single sensor element in a single arm of a conventional bridge circuit whose other arms are of a fixed impedance value. The full significance of the employment of multiple, variable impedance sensors in different arms of the same bridge circuit can, perhaps, be fully perceived, however, only by considering further examples of the types of radiation change causing occurrences which systems such as the apparatus 10 are adapted to detect.

One such example is that of an intruder moving through a space under surveillance by apparatus 10 employing a plurality of infrared radiation sensitive sensors, of which only the sensors 65 and 66 need be considered to illustrate the point of the example. Referring also to FIG. 2 and assuming that the intruder first enters the portion of the space being monitored which corresponds to the portion thereof from which radiations are concentrated upon the sensor having physical location 30 (the zone 46–47), such sensor (say impedance 65 in FIG. 3) will immediately sense heat radiations from the intruder and alter its impedance in correspondence with the increased radiation level to effect a change in the balance of the bridge circuit 60 for providing an initial output signal at the lead 88, it being noted that the impedance of the sensor corresponding to the sensor location 32 in FIG. 2 (say impedance 66 in FIG. 3), will remain relatively unchanged with respect to the level of radiations applied thereto (from the zone 55–56) and the resulting impedance value thereof. Assuming, however, that the intruder is moving in a direction across the space under surveillance toward the opposite side of the center line 50 of the mirror 20, he will next pass into a portion of the space being monitored corresponding to the area of greatest directional sensitivity of the sensor 66 having the location 32 in FIG. 2. When such transition of the intruder from the portion of the space served by sensor 65 (zone 46–47) into the portion of the space served by sensor 66 (zone 55–56) occurs, not only will the radiation level applied to the latter increase but the radiation level on the former will decrease during a very short time within a properly selected response time of the system, from which it will be apparent to those skilled in the art from the relationship of the sensor impedances 65 and 66 in FIG. 3 that the magnitude of the change in balance of the bridge circuit 60 that results from such occurrence is effectively "magnified" or, perhaps technically more accurately, the sensitivity of the bridge circuit 60 is substantially increased over what could be realized with only a single sensor monitoring the entire space.

A second example will illustrate a second sensitivity enhancing action of the invention, which is achievable independently of the effect noted in the preceding example, but which may be enjoyed in combination with the latter in constructions for realizing optimum sensitivity. Assume that a sensor electrically disposed at 68 in the bridge 60 of FIG. 3 is physically disposed, together with the sensor 65 of FIG. 3, so that both of such sensors 65 and 68 are adjacent the location 30 in FIG. 2 and arranged to both respond to radiations from the same or significantly overlapping portions of the space being monitored. A change in radiation from the relevant zone will result in changes of like sense in the electrical impedances of both of the sensors 65 and 68. However, because of the electrical juxtaposition of the sensors 65 and 68 in the bridge 60, those skilled in the art will readily perceive that the electrical effects of the impedance changes in the sensors 65 and 68 are additive, and that, in terms of the electrical output from the bridge 60 for a single radiation change event occurring in a single portion of the space being monitored, this aspect of the invention of itself essentially doubles the response or sensitivity of the system, in addition to such further performance enhancements as may be achieved through factors such as explained in the preceding example. As will be apparent, in such optimized arrangement, the sensor 67 may similarly be positionally "paired" with the sensor 66 for, say, location 32, and additional sensors for other positions in FIG. 2 and zones of the space being monitored may be electrically incorporated into a second bridge 70, as later explained. Also, in some applications, it is useful to employ different types of sensors for each sensor of each positionally coordinated "pair" thereof.

Continuing now the explanation of the remainder of the electrical portion of the apparatus 10, it is next observed that the electronic switch 100, which may typically be a thyristor or the like, and which is used for translating output signals from the output lead 88 of the differential amplifier 80 into "on-off" type control signals for activating an alarm or the like requiring higher power energization than provided by the output signals from the differential amplifier 80 itself, is provided with a control element input lead 102 and operates to open a continuity path between switched leads 104 and 106 thereof only in response to a voltage input to the control element lead 102 which is of a single polarity and of level in excess of some predetermined threshold value. It is necessary, therefore, in order for the uni-polar voltage controlled switching component 100 to satisfactorily respond to outputs from the differential amplifier 80 of either polarity (depending upon the sense of a change in the balance of the bridge circuit 60), that the bi-polar signals at the output lead 88 be suitably converted into the uni-polar control input required by the switching component 100, irrespective of the electrical polarity of the signal at the output lead 88. This is accomplished by the rectifying bridge 90, which has input terminals 91 and 92, output terminals 93 and 94, and diode or other suitable rectifying components 95, 96, 97 and 98 in the respective arms thereof. The output lead 88 from the differential amplifier 80 is coupled with the input terminal 91 of the rectifying bridge 90 and the other input terminals of the latter is connected with signal ground 98. The output terminal 93 of the rectifying bridge 90 is coupled with the control element 102 of the electronic switch 100 and the other output terminal 94 of the rectifying bridge 90 is coupled with one of the switched terminal leads 104 of the switching component 100. The switched terminal leads 104 and 106 of the switching component 100 are coupled in series with an internal "triggering" circuit of the multivibrator 110, so that such triggering circuit for the multivibrator 110 will be completed through the switching component 100 each time that the latter is rendered "closed" or conductive as between the terminals 104 and 106 thereof in response to the application to the control element terminal 102 thereof of a control signal voltage above the predetermined threshold level for the switching component 100 being employed.

In my preferred embodiment of the apparatus 10, the multivibrator 110, in conjunction with the switch 100, is effectively of the monostable or "one-shot" type in order to provide a separate pulse at the output lead 108 of the multivibrator 110 in response to each occurrence of a sufficient change in the radiation pattern from the space under surveillance to cause the switching component 100 to become conductive in the manner previously indicated; those skilled in the art will appreciate, however, that other conventional forms of multivibrator might be equivalently employed if it were desired that the pulse output to lead 108 of the multivibrator 110 should be in the form of a train of pulses continuing throughout the duration of any period in which the switching component 100 remains conductive due to changing radiation patterns from the space being monitored.

The driver amplifier 120, which may be of any conventional type, receives pulsed output via lead 108 from the multivibrator 110 and amplifies the same for presentation at its own output lead 122 to a level sufficient for driving the means provided for further utilization of signals representing a significant change in the radiation pattern from the space under surveillance. Such utilization means may, of course, be of various conventional types, such as an alarm circuit, a connection to communications equipment for transmitting the warning information to a remote location or the like. For simplicity, however, I employ in the preferred embodiment a relay 130 adapted to be actuated in response to an amplified pulse from the output lead 122 of the driver amplifier 120, which relay 130 controls the energization of any suitable type of alarm or warning device 140, such as a warning light, a bell or other audible warning signal generator or the like via an electrical control path 132, it being noted that it is felt necessary for full understanding by those skilled in the art to illustrate the components 130 and 140 and the electrical control coupling 132 in only functional block form (as has also been done for certain of the other components which are per se conventional and well known to those skilled in the art).

The portion of the preferred apparatus 10 thus far described with respect to its construction and functioning is, of itself, a fully operational and useful improvement over the radiation sensing alarm systems which have heretofore been available. As previously noted, however, I actually employ in the preferred embodiment a second bridge 70 having reference terminals 71 and 72, output terminals 73 and 74, dynamically variable impedance sensors 75, 76, 77 and 78 coupled in series with the respect arms of the bridge circuit 70, and an adjustable "balancing" resistance 79 in series with the bridge arm containing the impedance of the sensor 76. The purpose and functioning of the bridge circuit 70 and its components is, in general, the same as previously described for the bridge circuit 60, except that the bridge 70 may be provided to permit the electrical handling of the additional sensors required to divide the space being monitored into a greater number of sensing zones or in order to employ a different type of sensors 75, 76, 77 and 78 in the bridge circuit 70 than are used for the sensors 65, 66, 67 and 68 of the bridge circuit 60 (such as infrared radiation sensitive sensors in the bridge circuit 60 and sensors in the bridge circuit 70 which are of the type primarily sensitive to radiations in the visible light portion of the electromagnetic spectrum). Those skilled in the art will appreciate that the best types or combinations of sensors to be employed will tend to depend upon the nature of expected radiations from the space under surveillance, the number of zones of the space to be monitored and the kinds of changes in the normal radiation pattern from such space to which the apparatus 10 may be intended to respond. The sensors 75, 76, 77 and 78 of the bridge circuit 70 may be disposed in any desired locations along the rear of the shielding support bracket 22 in manner suitably arranged adjacent or interleaved between locations 30, 32, 34 and 36, and either "paired" with or offset from each other and the sensors 65, 66, 67 and 68 of the bridge circuit 60, with the relationships of individual sensors respectively associated with the bridges 60 and 70 juxtaposed in any desired manner relative to the mirror 20 for achieving a desired relationship of the electrical effects of their sensing functions appropriately correlated with the particular portions of the space under surveillance to which they primarily respond.

In the preferred embodiment, the reference terminals 71 and 72 of the bridge circuit 70 are respectively coupled with the negative reference voltge terminal 59 and the positive reference voltage terminal 58'. One of the output terminals 73 is coupled with the corresponding output lead 81 from the bridge circuit 60, and the other output terminal 74 of the bridge circuit 70 is capacitatively coupled through a capacitance 99 with the inverting input terminal of the differential amplifier 80. Thus, the bridge circuits 60 and 70 in the preferred embodiment, by virtue of the isolating action of the capacitances 84 and 99 and the inherent ground-seeking characteristic of the inverting input terminal of the amplifier 80, operate independently in presenting to the amplifier 80 signals representing changes in the radiation pattern from the space under surveillance. With proper juxtaposition of the respective sensors of the bridge circuits 60 and 70 in terms of the particular portions of the space under surveillance to which they primarily respond, it will be seen that an additive effect may be achieved in the overall input to the differential amplifier 80 for given changes in the pattern of radiation from the space being monitor, thereby further increasing the overall sensitivity of the apparatus 10. It will further be observed however, that the provision of the separate coupling capacitances 84 and 99 for the independently functioning bridge circuits 60 and 70 respectively retains the ability of the apparatus 10 to discriminate against and avoid generating "false alarms" from relatively slow but normal changes in ambient radiation conditions which might otherwise affect the bridge circuits 60 and 70 differently in view of the particular types of sensors being respectively employed therein. Aside from the noted function of the second bridge circuit 70 in increasing the sensitivity of the apparatus 10 to radiation pattern changes generally without a corresponding increase in susceptibility to "false alarms", together with the manner in which the provision of the second bridge circuit 70 employing a different type of sensors than the bridge circuit 60 permits the apparatus 10 to respond to changes in an increased number of types of radiation from the space under surveillance, the remainder of the preferred embodiment of the apparatus 10 commencing with the output from the differential amplifier 80 operates in substantially the same manner as previously described for the portion of the apparatus 10 involving the bridge circuit 60 only.

In some applications of radiation sensing type detection and alarm systems, it may be desirable to provide for separate detection of changes in patterns of different kinds of radiations and to further provide for the alarm portion(s) of the apparatus to either respond separately to changes in the pattern of a particular kind of radiations or cooperatively to the occurrence of "confirming" changes in the patterns of a plurality of different kinds of radiations, or in both of such manners. The modified form of apparatus (hereinafter referred to as 10') shown in FIG. 4 illustrates the manner in which my invention may be advantageously incorporated into system having such special requirements.

Referring to FIG. 4, it should first be understood that those components and connections therein, including the bridge circuit 60, capacitance 84, differential amplifier 80, rectifying bridge 90, electronic switch 100, multivibrator 110 and others immediately associated therewith, up through the output lead 108 of the multivibrator 110, are the same and function in essentially the same fashion as previously described for the correspondingly numbered portion of the preferred embodiment of FIG. 3. Secondly, the same portion of the preferred embodiment is duplicated with respect to the bridge circuit 160, capacitance 184, differential amplifier 180, rectifying bridge 190, electronic switch 200, multivibrator 210 and the components and connections immediately associated therewith, up through the output lead 208 of the multivibrator 210, with corresponding parts being identified by reference numerals which are greater by 100 than were employed for the preferred embodiment of FIG. 3 and the first described portion of FIG. 4, except that sensors responsive to differing kinds of radiation will presumably be employed in the bridge circuits 60 and 160 respectively of the modified apparatus 10'. As should be apparent such portions of the modified apparatus 10' separately sense, detect and produce at the output leads 108 and 208 of the multivibrators 110 and 210 respectively separate signals representing the occurrence of a significant change in the patterns of radiations from the space under surveillance respectively being sensed by the sensors of the bridge circuits 60 and 160. For example, the signals presented at output lead 108 may represent signficant changes in the pattern of infrared radiations from the space being monitored when the bridge circuit 60 is provided with infrared type sensors, while the signal presented at output lead 208 may represent significant changes in the pattern of visible light spectrum radiations from the space being monitored when the bridge circuit 160 incorporates sensors of the visible light sensitive type.

The separate signals respectively presented at output leads 108 and 208, representing changes in the patterns of differing types of radiations, may clearly be utilized for driving or actuating separate alarm or warning indication means. This is illustrated in FIG. 4 with respect to the signals that may be presented at the output lead 108 of multivibrator 110 by applying such signals to the input of a driver amplifier 120 whose output lead 122 is coupled to a relay 130 in turn functionally coupled with, say a warning indicator light 142 that is illuminated in response to the detection of significant changes in the infrared radiation pattern from the space under surveillance.

If the relay 130 which is employed is of the latching type, the indicator light 142 will remain illuminated after the first sensing of a significant change in the radiation pattern and until the apparatus 10' is "reset" in any conventional manner; if the relay 130 that is selected for use is not of the latching type, however, then the indicator lamp 142 will flash on and off in correspondence with each significant change of radiation pattern that is detected, and those skilled in the art will appreciate that the multivibrator 110 may be designed to produce pulses of virtually any desired length to establish an appropriate period for illumination of the indicator lamp 142 in response to each significant change of radiation pattern that is detected.

The signals separately presented at outputs 108 and 208 may also be utilized in combination with each other so as to provide an alarm response only when a significant change of radiation pattern is sensed by both the bridge circuit 60 and the bridge circuit 160 with respect to, say, infrared radiations and visible light spectrum radiations respectively. This too is illustrated in the apparatus 10' by the coupling of the two signal output leads 108 and 208 as the inputs to a logic AND gate device 150 which produces an output signal at its output lead 152 only when concurrent pulse signals are being received at its inputs from both of output leads 108 and 208. The output lead 152 of the gate 150 is fed to a driver amplifier 160 whose output controls a relay 170 that in turn functionally controls an alarm device 180 such as a bell or other audible warning generating component. Such requirement for "confirmation" of a sensed change in the patterns of two different types of radiation further decrease the susceptibility of the alarm 180 to undesired "false alarm" activations thereof.

It will be readily perceived by those skilled in the art that a number of minor modifications and variations of details of construction may readily be utilized to provide apparatus of forms that may be considered particularly adaptable to specific applications without departing fro the gist and essence of my invention. Accordingly, it is to be understood that my invention should be deemed limited only by the fair scope of the claims that follow including mechanical equivalents thereof.

I claim:

1. For use in alarm systems or the like wherein at least a pair of adjacent portions of a single space are under surveillance, apparatus for detecting changes in the nature of free-space radiations emanating from said adjacent portions resulting from an occurrence associated with an alarm condition including:

at least one pair of radiation responsive sensing means each having a pair of electrical connection points and characterized by presenting between said points an electrical parameter of variable level which changes in response to changes in the level of radiations being sensed, said one pair of said sensing means being operative to sense radiations emanating from said adjacent portions of said space;

means for rendering each of said one pair of said sensing means respectively operative to receive and sense radiations emanating from corresponding ones of said adjacent portions of said space;

electrical bridge circuit means having a pair of opposed reference terminals, a pair of opposed output terminals, and a plurality of electrically conductive bridge arms respectively extending to each of said output terminals respectively;

means electrically coupling said points of each of said one pair of said sensing means respectively in electrical series with the respective ones of one adjacent pair of said bridge arms; and means for detecting changes occurring in an electrical parameter presented between said output terminals in excess of a prescribed rate of change of said parameter and indicative of an alarm condition, whereby changes including those due either to a fire or to the presence of an intruder in either of said adjacent portions of said space will be detected, while slow changes due to gradual alteration of radiation conditions such as the ambient temperature of said adjacent portions will be ignored.

2. The invention of claim 1, wherein:

there is provided a second pair of said radiation responsive sensing means, said second pair of said sensing means being operative to sense radiations emanating from said adjacent portions of said space, said rendering means further functioning to render each of said second pair of said sensing means respectively operative to receive and sense radiations emanating from corresponding ones of said adjacent portions of said space, there being further provided means for electrically coupling said points of each of said second pair of said sensing means respectively in electrical series with the respective ones of the other adjacent pair of said bridge arms.

3. The invention of claim 2, wherein:

the sensing means coupled in one pair of opposing arms of said bridge circuit means are operative to sense radiations emanating from substantially overlapping areas within one of said adjacent portions and, the sensing means coupled in the other pair of opposing arms of said bridge circuit means are operative to sense radiations emanating from substantially overlapping areas within the other of said adjacent portions.

4. The invention of claim 1, wherein:

said sensing means is provided with directionally discriminatory means for receiving radiations to be sensed thereby, there being further provided radiation reflecting means, said receiving means of said sensing means being disposed between said space and said reflecting means and oriented away from said space and toward said reflecting means for receiving substantially only radiations reflected from the latter.

5. The invention of claim 1, wherein:

said detecting means includes a differential amplifier having the inputs thereof capacitatively coupled with said output terminals of said bridge circuit means.

6. The invention of claim 4, wherein:

said reflecting means comprise a curved mirror, and said receiving means are respectively disposed in differing angular orientations with respect to the focal characteristics of said mirror.

7. The invention of claim 1, wherein:

at least certain of said sensing means are primarily responsive to radiations in the infrared portion of the electromagnetic radiation spectrum.

8. The invention of claim 1, wherein:

at least certain of said sensing means are primarily responsive to radiations in the visible light portion of the electromagnetic radiation spectrum.

9. The invention of claim 1, wherein:

a direct current potential is applied across said reference terminals, the electrical parameter presented between said output terminals is a direct current potential of variable level, and the changes thereof to be detected may be of either electrical polarity, there is an alarm controlling switching means having a control terminal which responds for operating said switching means to electrical potentials of predetermined level but of one electrical polarity only, and there is provided means electrically coupled between said detecting means and said control terminal of said switching means for rectifying changes in said variable level potential to present a control signal of said one electrical polarity.

10. For use in alarm systems or the like wherein at least one portion of a single space is under surveilance, apparatus for detecting changes in the nature of freespace radiations emanating from said portion resulting from an occurrence associated with an alarm condition including:

a first plurality of radiation responsive sensing means each having a pair of electrical connection points and characterized by presenting between said points an electrical parameter of variable level which changes in response to changes in the level of radiations being sensed, at least one of the sensing means included in said first plurality thereof being operative to sense radiations emanating from said one portion of said space;

means for rendering each of the remaining of said first plurality of sensing means respectively operative to receive and sense radiations emanating from some corresponding portion of said space;

a second plurality of radiation responsive sensing means each having a pair of electrical connection points and characterized by presenting between said points an electrical parameter of variable level which changes in response to changes in the level of radiations being sensed, at least one of the sensing means included in said second plurality thereof being operative to sense radiations emanating from said one portion of said space;

means for rendering each of the remaining of said second plurality of sensing means respectively operative to receive and sense radiations emanating from some corresponding portion of said space;

first electrical bridge circuit means having a pair of opposed reference terminals, a pair of opposed output terminals, and a plurality of electrically conductive bridge arms respectively extending from each of said reference terminals respectively to each of said output terminals respectively;

means electrically coupling said points of each of said first plurality of sensing means respectively in electrical series with a different one of said bridge arms of said first bridge circuit means;

second electrical bridge circuit means having a pair of opposed reference terminals, a pair of opposed output terminals, and a plurality of electrically conductive bridge arms respectively extending from each of said reference terminals respectively to each of said output terminals respectively;

means electrically coupling said points of each of said second plurality of sensing means respectively in electrical series with a different one of said bridge arms of said second bridge circuit means;

detecting and control means electrically coupled with said output terminals of said first and second control bridge circuit means for activating an alarm or the like in response to changes occurring in an electrical parameter presented between said output terminals of either of said first and second bridge circuit means.

11. The invention of claim 10, wherein:

at least certain of said first sensing means are primarily responsive to radiations in the infrared portion of the electromagnetic radiation spectrum, and at least certain of said second sensing means are primarily responsive to radiations in the visible light portion of the electromagnetic radiation spectrum.

12. The invention of claim 10, wherein each of said rendering means includes:

radiation focusing means for a focusing radiations from said portions of said space including said one portion thereof for reception by corresponding ones of said sensing means.

13. The invention of claim 10, wherein:

said detecting and control means includes a differential amplifier having the inputs thereof capacitatively coupled with said output terminals of said first and second bridge circuit means, and said detecting and control means is operative to detect only those changes occurring in said electrical parameter in excess of a prescribed rate of change of said parameter and indicative of an alarm condition, whereby changes such as those due to a fire or the presence of an intruder in said portions of said space will be detected, while slow changes due to gradual alteration of radiation conditions such as the ambient temperature in said portions of said space will be ignored.

14. For use in alarm systems or the like wherein at least one portion of a single space is under surveillance, apparatus for detecting changes in the nature of freespace radiations emanating from said portion resulting from an occurrence associated with an alarm condition including:

at least one pair of radiation responsive sensing means each having a pair of electrical connection points and characterized by presenting between said points an electrical parameter of variable level which changes in response to changes in the level of radiations being sensed, each of said sensing means being respectively operative to sense radiations emanating from substantially overlapping areas in said one portion of said space;

electrical bridge circuit means having a pair of opposed reference terminals, a pair of opposed output terminals, and a plurality of electrically conductive bridge arms respectively extending from each of said reference terminals respectively to each of said output terminals respectively;

means electrically coupling said points of each of said one pair of said sensing means respectively in electrical series with the respective ones of one opposing pair of said bridge arms; and means for detecting changes occurring in an electrical parameter presented between output terminals.

15. The invention of claim 14, wherein there is further provided:

a second pair of said radiation responsive sensing means respectively operative to sense radiations emanating from another portion of said space; and means for electrically coupling said points of each of said second pair of said sensing means respectively in electrical series with the respective ones of the other opposing pair of said bridge arms.

16. The invention of claim 14, wherein:

said detecting means includes a differential amplifier having the inputs thereof capacitatively coupled with said output terminals of said bridge circuit means, said detecting means functioning to detect only those changes occurring in said electrical parameter in excess of a prescribed rate of change of said parameter and indicative of an alarm condition, whereby changes such as those due to a fire in said one portion of said space will be detected, while slow changes due to gradual alteration of radiation conditions such as the ambient temperature in said one portion of said space will be ignored.

* * * * *